United States Patent [19]

Whitworthl

[11] 4,409,951

[45] Oct. 18, 1983

[54] DEVICE TO IMPROVE THE FUEL EFFICIENCY OF AN INTERNAL COMBUSTION ENGINE

[76] Inventor: Edward T. Whitworth, R.R. #3, Port Rowan, Ontario, Canada

[21] Appl. No.: 156,742

[22] Filed: Jun. 5, 1980

[51] Int. Cl.[3] ..... F02M 29/00

[52] U.S. Cl. ..... 123/590; 261/78 R; 48/180 R

[58] Field of Search ..... 123/590, 591, 592, 593; 261/78 R; 48/180 R, 180 M

[56] References Cited

U.S. PATENT DOCUMENTS

| | | | |
|---|---|---|---|
| 3,747,581 | 7/1973 | Kolb | 123/593 |
| 3,968,780 | 7/1976 | Kononi et al. | 123/590 |
| 4,019,483 | 4/1977 | Kononi et al. | 123/590 |
| 4,058,102 | 11/1977 | Fabritz | 123/590 |
| 4,088,104 | 5/1978 | Ibbott | 123/590 |
| 4,281,632 | 8/1981 | Fenn | 123/590 |

*Primary Examiner*—Ira S. Lazarus

*Attorney, Agent, or Firm*—Daryl W. Schnurr

[57] ABSTRACT

This invention relates to a device to improve the fuel efficiency of an internal combustion engine. The device is preferably located between a carburetor and a manifold body and has a supporting plate with an opening aligned with and corresponding to size to a barrel of the carburetor. A truncated cone surrounds the opening and tapers away from it. The supporting plate is mounted so that fuel entering the device flows through a large end of the cone first. Preferably, there is one opening and corresponding cone for each barrel of the carburetor.

6 Claims, 7 Drawing Figures

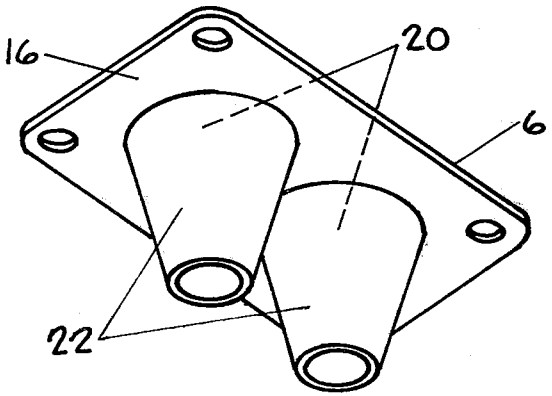
FIGURE 3
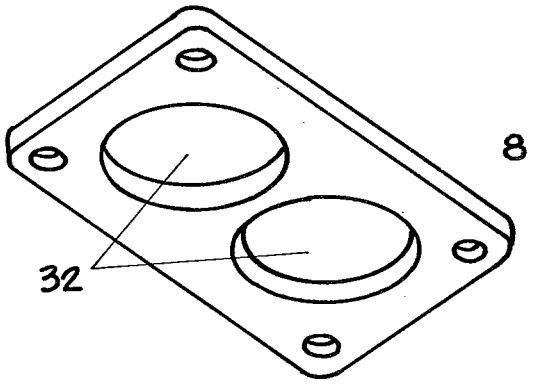
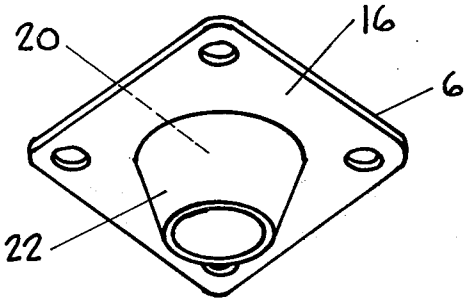
FIGURE 2
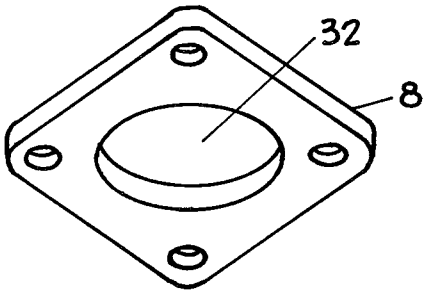

DEVICE TO IMPROVE THE FUEL EFFICIENCY OF AN INTERNAL COMBUSTION ENGINE

BACKGROUND OF THE INVENTION

1. Field of the Invention

This invention relates to a device to improve the fuel efficiency of an internal combustion engine. The device is used with a carburetor and a manifold body of an internal combustion engine having cylinders. The device is inserted in a conventional place between a fuel entrance to the carburetor and the cylinders of the internal combustion engine.

2. Description of the Prior Art

It has been recognized previously that the fuel efficiency of an internal combustion engine can be improved by increasing the degree of mixing of the fuel with air before the fuel-air mixture enters the manifold body. Various devices have been proposed for accomplishing this greater degree of mixing. For example, it is known to insert pointed metal projections coated with a non-wetting agent between the carburetor and the manifold body, or to slightly decrease the diameter of the conduit leading from the carburetor to the manifold body, or to insert converging webs into the entrance of the manifold body or to have a slight restriction in the pipe connecting to the manifold body, preferably, in the form of a venturi. These previous devices can not be installed on existing equipment without a great deal of expense, or, they are expensive to make, or, they do not improve the fuel efficiency of the internal combustion engine by an amount sufficient to justify their use. In any event, these previous devices are not widely used in automobiles manufactured today.

The world-wide gasoline crisis has now been upon us for more than five years and the desirability of using a device which is relatively inexpensive to make and simple to install without moving parts is in great demand. The demand becomes greater as the world price of fuel oil and therefore gasoline increases.

The device of the present invention can easily be inserted into existing motor vehicles. Also, it is relatively inexpensive to make as it is light-weight, it does not involve expensive and intricate fingers or webbing and it can be made quite easily and efficiently by automatic stamping machines. It could also be molded or casted right into the manifold or into the carburetor. The device could be used to replace the conventional venturi that is integrally formed within conventional carburetors.

SUMMARY OF THE INVENTION

This invention relates to a device to improve the fuel efficiency of an internal combustion engine. When the device is used with a four barrel carburetor and a manifold body of an internal combustion engine having cylinders, the device is located between the carburetor and the manifold body. The device has a supporting plate having an opening aligned with and substantially corresponding in size to each barrel of said carburetor with a truncated cone surrounding and tapering away from the two openings that are adjacent to the two smaller barrels. The device is positioned so that a fuel air mixture formed in said carburetor will enter said device through a large end of the cone first. The size of the opening at a small end of said cone when compared to the size of the opening at the large end constitutes an extreme restriction of the flow area.

The device can be used with a two stage, two barrel carburetor in essentially the same manner as with a four barrel carburetor with a truncated cone surrounding and tapering away from an opening aligned with and substantially corresponding in size to the smaller barrel.

BRIEF DESCRIPTION OF THE DRAWINGS

In drawings which illustrate the embodiments of the invention:

FIG. 2 is an exploded perspective view of the device of the present invention and spacing plate for use with a single-barrel carburetor;

FIG. 3 is an exploded perspective view of the device of the present invention and spacing plate for use with a two-barrel carburetor;

DESCRIPTION OF A PREFERRED EMBODIMENT

Figure 1:
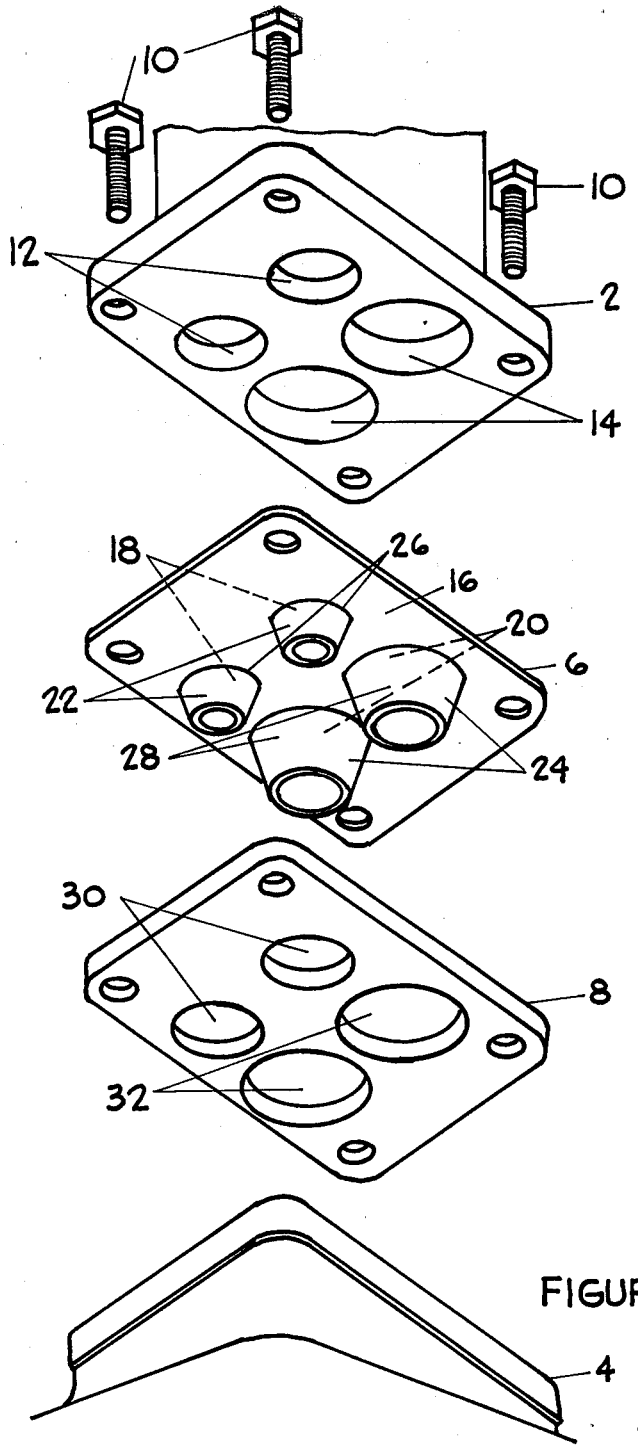
FIG. 1 is an exploded perspective view of the device of the present invention located between a carburetor and a manifold body.

Referring to FIG. 1 in greater detail, there is shown a partial carburetor 2 and a partial manifold body 4. Located between said carburetor 2 and manifold body 4 is a device 6 for improving the fuel efficiency of an internal combustion engine and a spacing plate 8. Conventional gaskets to prevent fuel leakage from the system have been purposely omitted to maintain the simplicity of the drawings and the necessity of these gaskets will be readily apparent to those skilled in the art. Bolts 10 are used to bolt the various components 2, 6, 8, 4 together during operation. The carburetor 2 has four barrels, two small barrels 12 and two larger barrels 14. The device 6 is located between the carburetor 2 and the manifold body 4 directly underneath the carburetor 2. A supporting plate 16 of the device 6 has two small openings 18 and two large openings 20. The openings 18, 20 are aligned with and correspond in size to the barrels 12, 14 respectively of the carburetor 2. Surrounding and tapering away from the said openings 18, 20 are truncated cones 22, 24, respectively. The truncated cones 22 are smaller than the cones 24 simply because the openings 18 are smaller than the openings 20. In particular applications, it may be desirable to extend the depth of one or both sets of cones 22, 24. The device 6 is mounted so that the fuel-air mixture (not shown) entering the device from the carburetor 2 flows through large ends 26, 28 of the cones 22, 24 respectively first.

FIG. 1 shows the arrangement of the barrels in a typical four-barrel carburetor 2. The two larger barrels 14 are only utilized when the vehicle is caused to accelerate rapidly or is driven at high speeds. While there is one opening 18, 20 and corresponding cone 22, 24 aligned with and corresponding to each barrel 12, 14 of the carburetor, the present invention could still be utilized as long as there was at least one opening and cone aligned with, and corresponding to one barrel of the carburetor. Of course, it would be essential for suitable openings to correspond and align with the remaining barrels.

Further, the device of the present invention can be used quite satisfactorily with a four-barrel carburetor when there are openings and corresponding truncated cones aligned with and corresponding to the two smaller barrels of the carburetor and openings without cones aligned with and corresponding to the two larger barrels of the carburetor.

The spacing plate 8 is located adjacent to said supporting plate 16 between said supporting plate and said manifold body 4. The spacing plate is the same size as the supporting plate 16 and has openings 30 aligned with and slightly larger in size compared to the corresponding openings 18, 20 respectively of the supporting plate 16. The openings 30, 32 of the spacing plate 8 must be slightly larger than the openings 18, 20 of the supporting plate 16 to account for the wall thickness of the cones 22, 24 respectively so that the spacing plate 8 can rest against the supporting plate 16 when properly mounted between the device 6 and the manifold body 4. The spacing plate 8 is not required when the device is used with certain engines. Some engines have a sharp angle in the conduit following the carburetor and leading into the manifold. Because of the sharp angle of certain engines, there is not sufficient space for the proper use of the device 6. The spacing plate 8 simply increases the space between the device 6 and a particular manifold body.

Referring to FIG. 2 in greater detail, there is shown a device 6 to improve the fuel efficiency of an internal combustion engine having a carburetor with a single barrel 12. There is only one centrally located opening 20 in the supporting plate 16 and one truncated cone 22. Also shown in FIG. 2 is a spacing plate 8 having one centrally located opening 32 slightly larger in size compared to the opening 20 of the supporting plate 16.

Referring to FIG. 3 in greater detail, there is shown a device 6 to improve the fuel efficiency of an internal combustion engine having a double-barrelled carburetor. There are two suitably located openings 20, in the supporting plate 16 and two truncated cones 22. Also shown in FIG. 3 is a spacing plate 8 having two centrally located openings 32 slightly larger in size compared to the opening 20 of the supporting plate 16. The cones 22 are discussed in more detail below.

Figure 4:
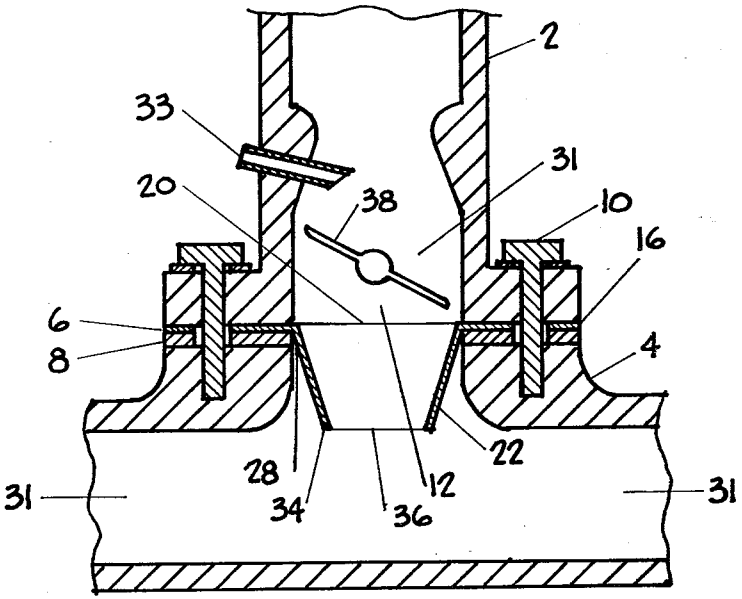
FIG. 4 is a sectional side view of the device of the present invention mounted between a single-barrel carburetor and a manifold body.

Referring to FIG. 4 in greater detail, there is shown a device 6 of the present invention and a spacing plate 8 located in a channel 31 between a fuel entrance 33 of the carburetor 2 and cylinders (not shown) of the internal combustion engine (also not shown). The channel 31 is formed within a single-barrelled carburetor 2 and a manifold body 4. While the device 6 is actually located between the carburetor 2 and a manifold body 4, it could be located in any convenient place in the channel 31 between the fuel entrance 33 and the cylinders of the engine. The supporting plate 16 has an opening 20 aligned with and substantially corresponding in size to the channel 31 in which it is located. The size of the channel 31 in this location is actually the size of a barrel 12 of the carburetor 2. A truncated cone 22 surrounds and tapers away from the opening 20. It can readily be seen that the device 6 is positioned so that a fuel-air mixture formed in the carburetor 2 will enter the device 6 through a large end 28 of the cone 22 first before exiting from a small end 34 through an opening 36. A conventional butterfly valve 38 controls the entry of the fuel-air mixture into the device 6. Again, as with FIG. 1, conventional gaskets to prevent the fuel-air mixture from leaking from the system have been omitted from FIG. 4 for purposes of simplification. The use of these gaskets will be readily apparent to those skilled in the art.

Figure 5:
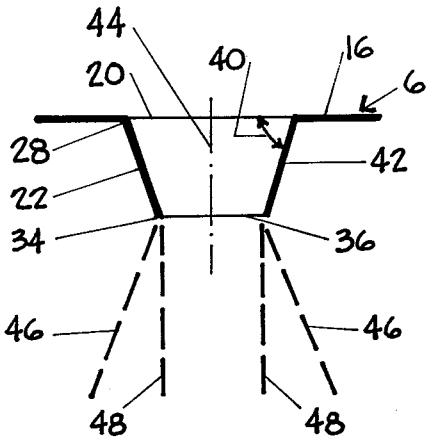
FIG. 5 is a schematic sectional view of the side of the device showing the general shape of supersonic flow from the device.

Referring to FIG. 5 in greater detail, in a schematic view of the device 6, there is shown an acute angle 40 of a tapered wall 42 of the cone 22 relative to the supporting plate 16. Preferably, that acute angle 40 ranges from 70 degrees to 76 degrees.

Also, as shown in FIG. 5, a cone 22 has a central axis 44, an opening 20 at the large end 28 and an opening 36 at the small end 34. The diameter of the opening 36 at the small end 34 is equal to the length of the central axis 44 between said small end 34 and said large end 28. In addition, said length of the central axis 44 is in turn equal to 0.61804 times the diameter of the opening 20 of said large end 28 of said cone 22. In other words, if the diameter of the opening 20 is $d_1$, the diameter of the opening 36 is $d_2$ and the length of the central axis 44 between said small and large ends is D, the following equation results:

$$D=d_2=0.61804\ d_1$$

When the equation immediately above is satisfied, the acute angle 40 can be readily calculated from natural trigonometric tables to be substantially 72 degrees 49 minutes 43 seconds. This angle is the preferred acute angle 40.

Finally, in reference to FIG. 5, there is shown an example of what is meant by the phrase "supersonic shape." Supersonic shape means that the side boundaries of a fuel-air mixture exiting from the small opening 36 expand outwards as indicated by dotted lines 46. If the exit was a "sonic shape," the side boundaries would be parallel as shown by dotted lines 48.

It is known that sonic flow through a truncated cone changes to supersonic flow at the speed of sound. It is also known that the speed of sound in air is 767 miles per hour at one atmosphere and room temperature.

Since $d_1$ is the diameter of the opening at the large end of the cone and $d_2$ is the diameter of the opening at the small end of the cone, it is possible to calculate the extreme restriction in flow area when the equation $d_2=0.61804\ d_1$ is satisfied. Since both openings are circles, it is a relatively simple matter to calculate the area of the opening at the large end of the cone and the area of the opening at the small end of the cone. The percent restriction can then be obtained simply by dividing the difference between the area of the cone inlet and the area of the cone outlet by the area of the cone inlet. When this is done, the restriction between the area of size of the opening at the large end of the cone and the area or size of the opening at the small end of the cone is 61.8 percent. In particular applications, where it is desirable to extend the depth of the cone, the percent restriction will be greater than 62 percent. Of course, when the cones are lengthened, the equation $d_2=0.61804\ d_1$ will no longer be satisfied. The area of the cone outlet ($A_{co}$) can be calculated in accordance with the equation discussed below.

Figure 6:
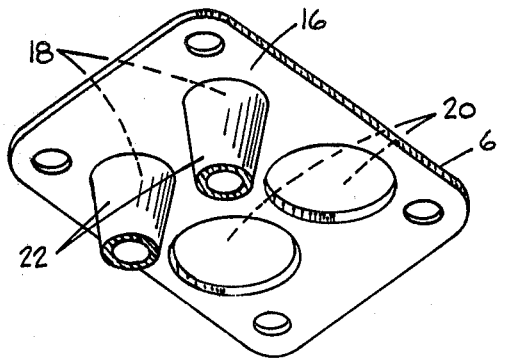
FIG. 6 is a perspective view of the device having two cones for use with a four barrel carburetor; and, FIG. 7 is a perspective view of the device having one cone for use with a two barrel carburetor.

In FIG. 6, there is shown a device 6 in accordance with the present invention for use with a four barrel carburetor (not shown). There is a cone 22 on each smaller opening 18. The openings 18 correspond to the smaller or primary barrels of the carburetor. While there are larger openings 20 which are corresponding in size and are designed to align with the larger or secondary barrels of the carburetor, there are no cones on the openings 20 in this embodiment of the device 6. The larger or secondary barrels of the carburetor are not used during the normal operation of a motor vehicle. The larger or secondary barrels are used at high speeds or when the passing gear of the vehicle is utilized.

Figure 7:
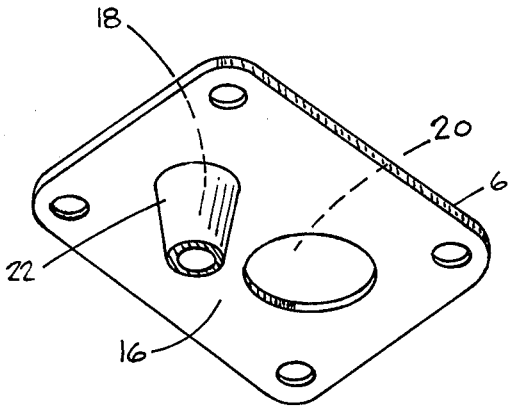

FIG. 7 discloses a device 6 in accordance with the present invention which can be used with a two barrel, two stage carburetor (not shown). A two barrel, two stage carburetor works in the same manner as a four barrel carburetor. There is one primary or smaller barrel that is utilized during normal operation of the vehicle and a secondary or larger barrel that is used at high speeds or when passing. A cone 22 is located on the smaller opening 18 but no cone is located on the larger opening 20. The smaller opening 18 corresponds to the smaller or primary barrel of the carburetor and the larger opening 20 corresponds to the larger or secondary barrel of the carburetor.

As shown in FIG. 3, the cone 22 has a central axis or depth greater than that required to satisfy the equation $D=d_2=0.61804\ d_1$. Although the acute angle (not shown) of the cone 22 in FIG. 3 is substantially 72 degrees 49 minutes and 43 seconds, the preferred depth is calculated by the following equation which yields the area of the small opening of the cone or cone outlet 36 for specific engine size and engine speed (i.e. RPM). The equation is as follows:

$$A_{co} = \frac{E \times SC \times RPM}{V_{co} \times NC}$$

where:

$A_{co}$ is the area of the cone outlet;

E is the engine displacement;

SC is the suction cycle of the engine (i.e. most cylinders of internal combustion engines used in motor vehicles are designed so that one-half of the cylinders are filled with air during each revolution. This means that the suction cycle is 0.5/rev.);

RPM is the number of revolutions per minute of the engine;

$V_{co}$ is 0.61804 times the desired velocity of the air passing through the cone outlet. For the speed of sound, $V_{co}$ would equal $767 \times 0.61804 = 474$ miles per hour;

NC is the number of cones.

The RPM is usually chosen according to the speed that the vehicle is most commonly driven. For example, 2500 RPM may be the engine speed at a vehicle speed of 55 miles per hour. As an example of the use of the above equation, assuming that the engine displacement is 350 cubic inches, the desired $V_{co}$ is 474 miles per hour and the number of cones is two, $A_{co}$ can be calculated as follows:

$$A_{co} = \frac{350\ \text{in.}^3}{2\ \text{cones}} \times \frac{0.5}{\text{revolution}} \times \frac{2500\ rev.}{\text{min.}} \times \frac{1\ \text{hr.}}{474\ \text{mi.}} \times \frac{1\ \text{mi.}}{5280\ \text{ft.}} \times \frac{1\ \text{ft.}}{12\ \text{in.}} \times \frac{60\ \text{min.}}{1\ \text{hr.}} = 0.437\ \text{in.}^2$$

Therefore, the diameter of the cone outlet is 0.746 inches.

The above equation for calculating the area of the cone outlet was derived experimentally using cones having an acute angle as defined above of substantially 72 degrees 49 minutes 43 seconds. Of course, the size of the acute angle is theoretical only and when constructing a cone, it is difficult to obtain an angle to the desired accuracy. Preferably, the acute angle ranges from 70 degrees to 76 degrees. Still more preferably, the acute angle is substantially 73 degrees.

By decreasing the angle 40 below 70 degrees, it is expected that mileage will increase up to a given point but that there will be a serious decrease in power. Similarly, if the acute angle is increased above 76 degrees, it is expected that there will be a slight increase in power but mileage will decrease.

Before entering the opening 20, the flow of the fuel-air mixture has a sonic shape. When the fuel-air mixture exits from the opening 36, it is expected that the flow has a supersonic shape. The extra turbulence of the supersonic shape results in greater mixture of the fuel with the air. The end result is increased efficiency of the burning of the mixture in the cylinders of the internal combustion engine.

The truncated cones used in the present invention represent an extreme restriction within the carburetor-manifold system. Theoretically, this reults in an extreme pressure drop to create a high vacuum at the cone exit. This high vacuum in turn causes the dispersed fuel to vaporize at a lower temperature. It is well known that the pressure at the cone outlet will continue to drop until the fuel-air mixture is flowing through the cone at the speed of sound. Theoretically, the fuel efficiency of the engine will continue to increase until such time as the fuel-air mixture flows through the cone at the speed of sound. The velocity of the fuel-air mixture through the cone increases with an increase in the engine RPM.

Because of the increased burning efficiency, exhaust emissions will contain fewer contaminents and the engine should last longer. When the device of the present invention was used with the internal combustion engine of a motor vehicle, it was noticed that there was a decrease in engine and exhaust noises. In addition, the tail pipe was a greyish colour rather than the usual black colour when the device was not used. The following are examples of the improvements in the fuel efficiency through the use of the device. In each example, the acute angle of the cone was substantially 73 degrees and the above equation for calculating the area of the cone outlet was satisfied.

EXAMPLE I

The following test results were obtained using the device of the present invention and the corresponding spacer plate with a 1976 CADILLAC (a trade mark) having a 500 cubic inch displacement four cycle engine. The device had four cones to correspond with the four barrels of the carburetor of the engine. Each cone satisfied the equation $D=d_2=0.61804\ d_1$ as set out above in reference to FIG. 5. The following results were achieved:

| | WITHOUT DEVICE | WITH DEVICE | PERCENTAGE IMPROVEMENT |
|---|---|---|---|
| City Miles Per Imperial Gallon | 10.20 | 16.10 | 58% |
| Highway Miles Per | 16.11 | 24.22 | 51% |

-continued

| | WITHOUT DEVICE | WITH DEVICE | PERCENTAGE IMPROVEMENT |
|---|---|---|---|
| Imperial Gallon | | | |

EXAMPLE II

A 1978 CORVETTE (a trade mark) was used having a 350 cubic inch displacement four cycle engine. A spacing plate was used and the device had two cones to correspond with the two smaller barrels of the four barrel carburetor of the engine. The diameter of the cone outlet was 0.746 inches and the following results were achieved:

| | WITHOUT DEVICE | WITH DEVICE | PERCENTAGE IMPROVEMENT |
|---|---|---|---|
| Highway Miles Per Imperial Gallon | 21.45 | 28.0 | 30% |

EXAMPLE III

A 1979 CHEVROLET (a trade mark) one-half ton pick-up truck was used having a 350 cubic inch displacement four cycle engine. A spacing plate was used and the device had two cones to correspond with the two smaller barrels of the four barrel carburetor of the engine. The diameter of the cone outlet was 0.746 inches and the following results were achieved:

| | WITHOUT DEVICE | WITH DEVICE | PERCENTAGE IMPROVEMENT |
|---|---|---|---|
| Highway Miles Per Imperial Gallon | 9.8 | 14.9 | 50% |

It should be noted that when the tests were conducted with cones only corresponding to the two smaller barrels of the four-barrel carburetor, the vehicles were driven in such a manner that the two larger barrels would not come into use. In other words, passing gear was not used, the vehicles were not accelerated rapidly and they were driven on the highway at a top speed of substantially 55 miles per hour. For example, with the CORVETTE, the two larger barrels were not utilized until a speed of 90 miles per hour and on the pick-up truck, the larger barrels were not used until a speed of 70 miles per hour was achieved. Therefore, at 55 miles per hour the two larger barrels would not be utilized. The results were measured through the use of the odometer and a fuel pump meter.

What I claim as my invention is:

1. For use with a four barrel carburetor and a manifold body of an internal combustion engine having cylinders, a device to improve the fuel efficiency of said engine, said device being located between the carburetor and manifold body, said device comprising a supporting plate having an opening aligned with and substantially corresponding in size to each barrel of said carburetor with a truncated cone surrounding and tapering away from the two openings that are adjacent to the two smaller barrels, said device being positioned so that a fuel-air mixture formed in said carburetor will enter said device through a large end of said cone first, the size of the opening at a small end of said cone when compared to the size of the opening at the large end constituting an extreme restriction of the flow area.

2. For use with a two stage two barrel carburetor and a manifold body of an internal combustion engine having cylinders, a device to improve the fuel efficiency of said engine, said device being located between the carburetor and manifold body, said device comprising a supporting plate having an opening aligned with and substantially corresponding in size to each barrel of said carburetor with a truncated cone surrounding and tapering away from the smaller barrel, said device being positioned so that a fuel-air mixture formed in said carburetor will enter said device through a large end of said cone first, the size of the opening at a small end of said cone when compared to the size of the opening at said large end constituting an extreme restriction of the flow area.

3. A device as claimed in any one of claims 1 or 2 wherein the restriction of the flow area is greater than 50 percent.

4. A device as claimed in any one of claims 1 or 2 wherein the restriction of the flow area is greater than 60 percent.

5. A device as claimed in any of claims 1 or 2 wherein the acute angle of the tapered wall of each cone relative to said supporting plate ranges from 70 degrees to 76 degrees.

6. A device as claimed in any of claims 1 or 2 wherein the acute angle of the tapered wall of each cone relative to the supporting plate is substantially 73 degrees.

* * * * *